US009278835B2

(12) United States Patent
Lin et al.

(10) Patent No.: US 9,278,835 B2
(45) Date of Patent: Mar. 8, 2016

(54) HYDRAULIC PUSHING DEVICE

(71) Applicant: Dalian University of Technology, Dalian (CN)

(72) Inventors: Yan Lin, Dalian (CN); Ming Chen, Dalian (CN); Yanyun Yu, Dalian (CN); Zhuoshang Ji, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 97 days.

(21) Appl. No.: 14/332,411

(22) Filed: Jul. 16, 2014

(65) Prior Publication Data

US 2014/0326937 A1 Nov. 6, 2014

Related U.S. Application Data

(63) Continuation-in-part of application No. PCT/CN2012/001280, filed on Sep. 18, 2012.

(30) Foreign Application Priority Data

Jan. 17, 2012 (CN) ..... 2012 1 0014452

(51) Int. Cl.

| | |
|---|---|
| ***B66F 3/24*** | (2006.01) |
| ***B63C 3/00*** | (2006.01) |
| ***B63B 9/00*** | (2006.01) |
| ***B63C 13/00*** | (2006.01) |

(52) U.S. Cl.

CPC ... *B66F 3/24* (2013.01); *B63B 9/00* (2013.01); *B63C 3/00* (2013.01); *B63C 13/00* (2013.01); *B66F 2700/05* (2013.01)

(58) Field of Classification Search

CPC ..... B66F 3/24; B66F 3/247; B66F 19/00; B65F 7/00; B65F 7/02

See application file for complete search history.

(56) References Cited

U.S. PATENT DOCUMENTS

| | | | | | |
|---|---|---|---|---|---|
| 3,081,066 | A * | 3/1963 | Murawski | A62B 3/005 | 254/93 R |
| 3,478,525 | A * | 11/1969 | Van Der Hoeven | B63B 9/00 | 114/65 R |
| 3,656,446 | A * | 4/1972 | Heffernan | B60V 3/025 | 114/77 R |
| 4,544,135 | A * | 10/1985 | Albaugh | B66F 1/08 | 254/108 |
| 5,496,013 | A * | 3/1996 | Lussier | B65G 7/02 | 254/105 |
| 2005/0129493 | A1 * | 6/2005 | Lavoie | B65G 7/02 | 414/529 |

FOREIGN PATENT DOCUMENTS

| | | | | |
|---|---|---|---|---|
| DE | 2447892 | A1 * | 4/1975 | B65G 7/02 |
| GB | 1089670 | A * | 11/1967 | B62D 57/00 |
| JP | 59057804 | A * | 4/1984 | |

* cited by examiner

*Primary Examiner* — Lee D Wilson
*Assistant Examiner* — Tyrone V Hall, Jr.
(74) *Attorney, Agent, or Firm* — Matthias Scholl, PC; Matthias Scholl

(57) ABSTRACT

A hydraulic pushing device, including: a hydraulic unit, a rear seat, a front seat, a prying mechanism, an automatic adjustment mechanism, and a zero-torque pushing mechanism. The hydraulic unit and the rear seat are disposed on a platform. The zero-torque pushing mechanism includes two hydraulic cylinders, one end of each of the two hydraulic cylinders is hinged to the rear seat via a third hinge pin, and the other end of each of the two hydraulic cylinders is hinged to the front seat via a second hinge pin. The automatic adjustment mechanism includes a control lever and two locating pieces. One end of the control lever is in a fixed connection to the front seat, and the other end of the control lever is clamped by the two locating pieces. The prying mechanism includes two pawls, a pawl shaft, two prying guides, and two rows of equidistantly-disposed stop pieces.

6 Claims, 4 Drawing Sheets

HYDRAULIC PUSHING DEVICE

CROSS-REFERENCE TO RELATED APPLICATIONS

This application is a continuation-in-part of International Patent Application No. PCT/CN2012/001280 with an international filing date of Sep. 18, 2012, designating the United States, now pending, and further claims priority benefits to Chinese Patent Application No. 201210014452.6 filed Jan. 17, 2012. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

1. Field of the Invention

The invention relates to a zero-torque hydraulic pushing device adapted to automatically rectify a deviation in the process of ground shipbuilding and land-sea connection and loading.

2. Description of the Related Art

Ground shipbuilding needs to shift ships, marine engineering equipment and large structures. Typically, shifting is achieved by a trolley moving on a track or a slide plate sliding on a slideway, both of which involve a traction power system in a pulling or pushing mode.

SUMMARY OF THE INVENTION

In view of the above-described problems, it is one objective of the invention to provide a zero-torque hydraulic pushing device for ground shipbuilding and land-sea connection and loading. The hydraulic pushing device is adapted to automatically rectify a deviation without involvement of a torque in a slideway shifting system or in a track shifting system, features a simple structure, convenient maintenance, high engineering applicability, safety, and reliability, and is compatible with operational environment, production processes and procedures of existing shipyards.

To achieve the above objective, in accordance with one embodiment of the invention, there is provided a hydraulic pushing device, the hydraulic pushing device moving on a lower slide rail to push an upper slide plate disposed on the lower slide rail to shift, the hydraulic pushing device comprising: a hydraulic unit, a rear seat, a front seat, a prying mechanism, an automatic adjustment mechanism, and a zero-torque pushing mechanism. The hydraulic unit and the rear seat are disposed on a platform. The front seat is in a fixed connection to the upper slide plate via a connecting flange. The zero-torque pushing mechanism comprises two hydraulic cylinders, one end of each of the two hydraulic cylinders is hinged to the rear seat via a third hinge pin, and the other end of each of the two hydraulic cylinders is hinged to the front seat via a second hinge pin. The automatic adjustment mechanism comprises a control lever and two locating pieces, one end of the control lever is in a fixed connection to the front seat, and the other end of the control lever is clamped by the two locating pieces which are fixed on the rear seat. The prying mechanism comprises two pawls, a pawl shaft, two prying guides, and two rows of equidistantly-disposed stop pieces; the pawl shaft is disposed between a baffle plate and a front round block leaning against the rear seat; the two pawls are interlocked with two ends of the pawl shaft, respectively; a middle part of each pawl is hinged to the prying guide straddling the stop pieces via a first hinge pin. When the hydraulic cylinders lift, the pawls grasp the stop pieces tightly, and the hydraulic cylinders push the upper slide plate to move forward; when the hydraulic cylinders contract, the platform moves forward, under the drive of the pawl shaft, the pawls and the prying guide lean against the stop pieces and move forward until the pawls grasp next stop pieces for next cycle of pushing.

In a class of this embodiment, the prying guide employs two plates disposed at two sides of the stop piece, and the prying guide comprises a long pin hole matching the first hinge pin.

In a class of this embodiment, a lower press block is disposed at a lower part of the front round block leaning against the pawl shaft, and an upper press block is disposed at an upper part of the front round block.

In a class of this embodiment, inclined support bars in a fixed connection to the front seat are disposed at two sides of the control lever, respectively.

In a class of this embodiment, the stop pieces are fixed on the lower slide rail, and correspond to the pawl.

In a class of this embodiment, rollers are disposed at both sides of a bottom of the platform.

Compared with the prior art, advantages of the invention are summarized as follows. The hydraulic pushing device comprises a hydraulic unit, a rear seat, a front seat, a prying mechanism, an automatic adjustment mechanism, and a zero-torque pushing mechanism. The zero-torque pushing mechanism comprises two hydraulic cylinders. One end of the two hydraulic cylinders is hinged to the rear seat, and the other end of the two hydraulic cylinders is hinged to the front seat. The zero-torque hydraulic pushing device is adapted to automatically rectify a deviation in a slideway shifting system or in a track shifting system. The prying mechanism and the automatic adjustment mechanism cooperate to precisely, controllably, quickly shift large-tonnage structures with large-scale and complex shape. The device features a simple structure, convenient maintenance, high engineering applicability, safety, and reliability, and is compatible with operational environment, production processes and procedures of existing shipyards, so that the production capacity of the shipyard is increased, the production period is shortened, and the launching passage and the launching safety of large-scale structures are improved.

Figure 1:
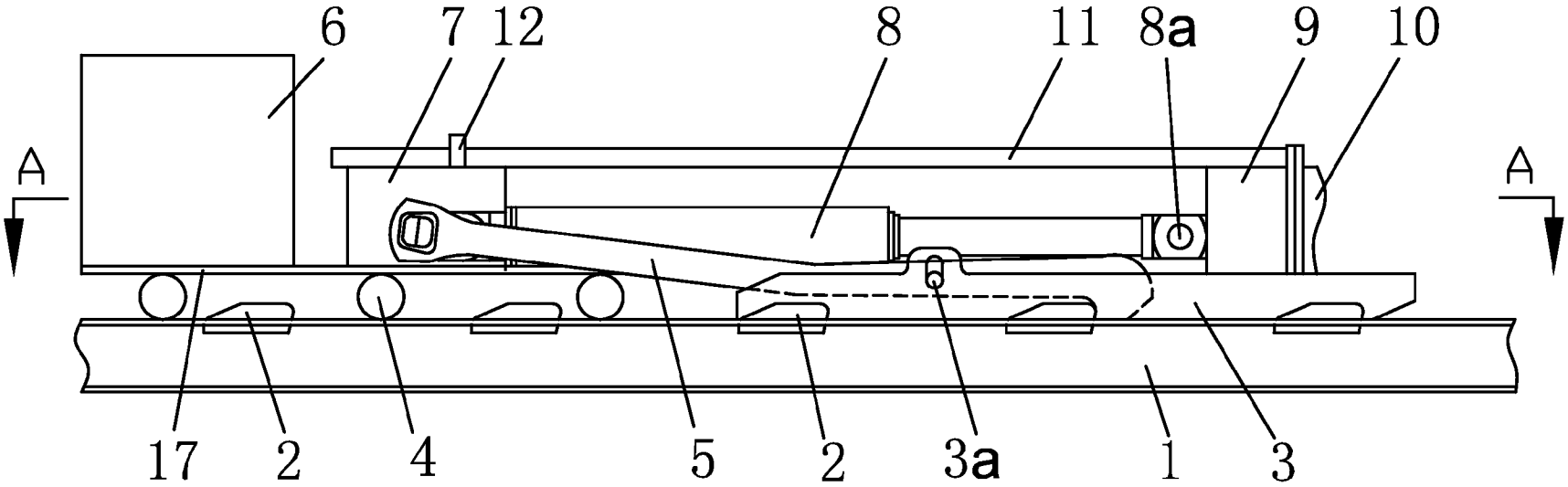
FIG. 1 is a front view of a hydraulic pushing device according to one embodiment of the invention.

In the drawings, the following numbers are used: 1. Lower slide rail; 2. Stop piece; 3. Prying guide; 3*a*. Hinge pin; 4. Roller; 5. Pawl; 6. Hydraulic unit; 7. Rear seat; 8. Hydraulic cylinder; 8*a*. Second hinge pin; 8*b*. Third hinge pin; 9. Front seat; 10. Upper slide plate; 10*a*. Connecting flange; 11. Control lever; 11*a*. Inclined support bar; 12. Locating piece; 13. Pawl shaft; 13*a*. Shaft sleeve; 14. Front round block; 15. Lower press block; 16. Upper press block; 17. Platform; 18. Baffle plate.

DETAILED DESCRIPTION OF THE EMBODIMENTS

For further illustrating the invention, experiments detailing a hydraulic pushing device are described hereinbelow combined with the drawings.

Figure 2:
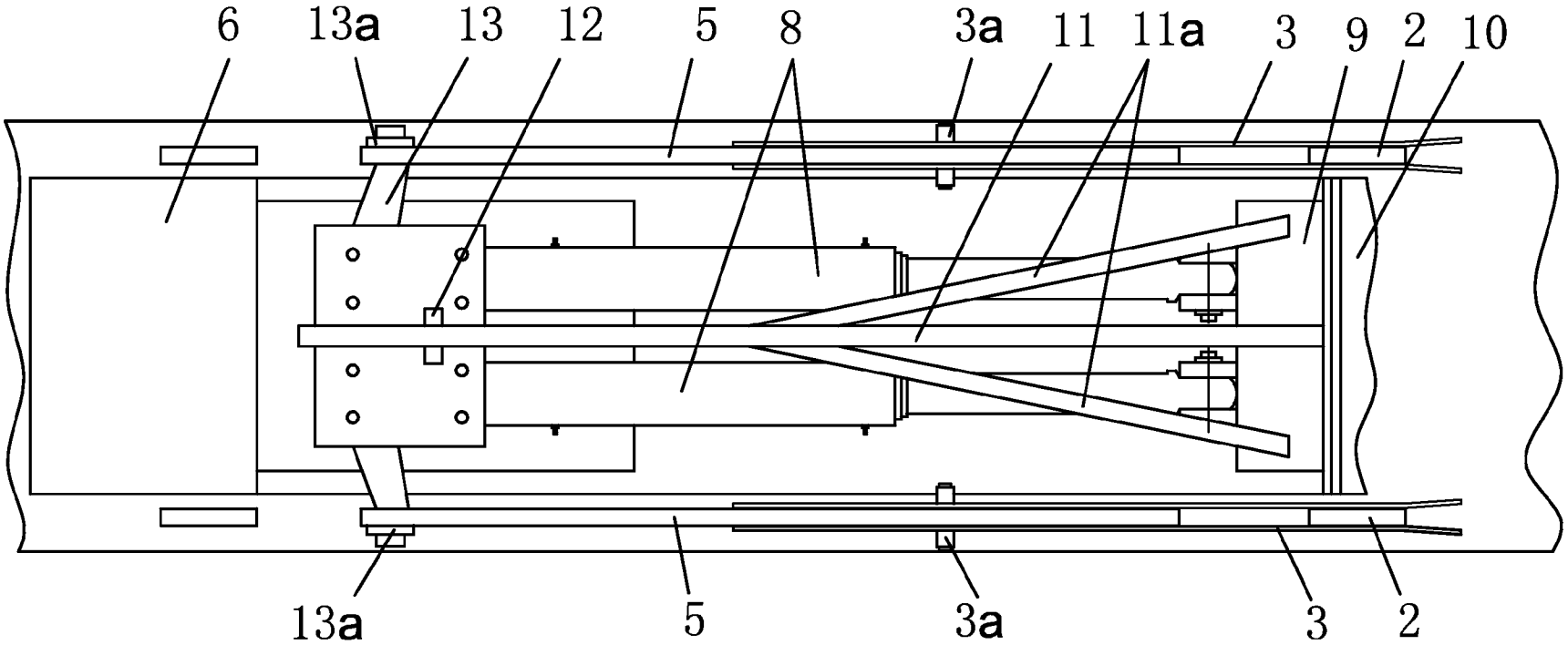
FIG. 2 is a top view of a hydraulic pushing device according to one embodiment of the invention.
Figure 3:
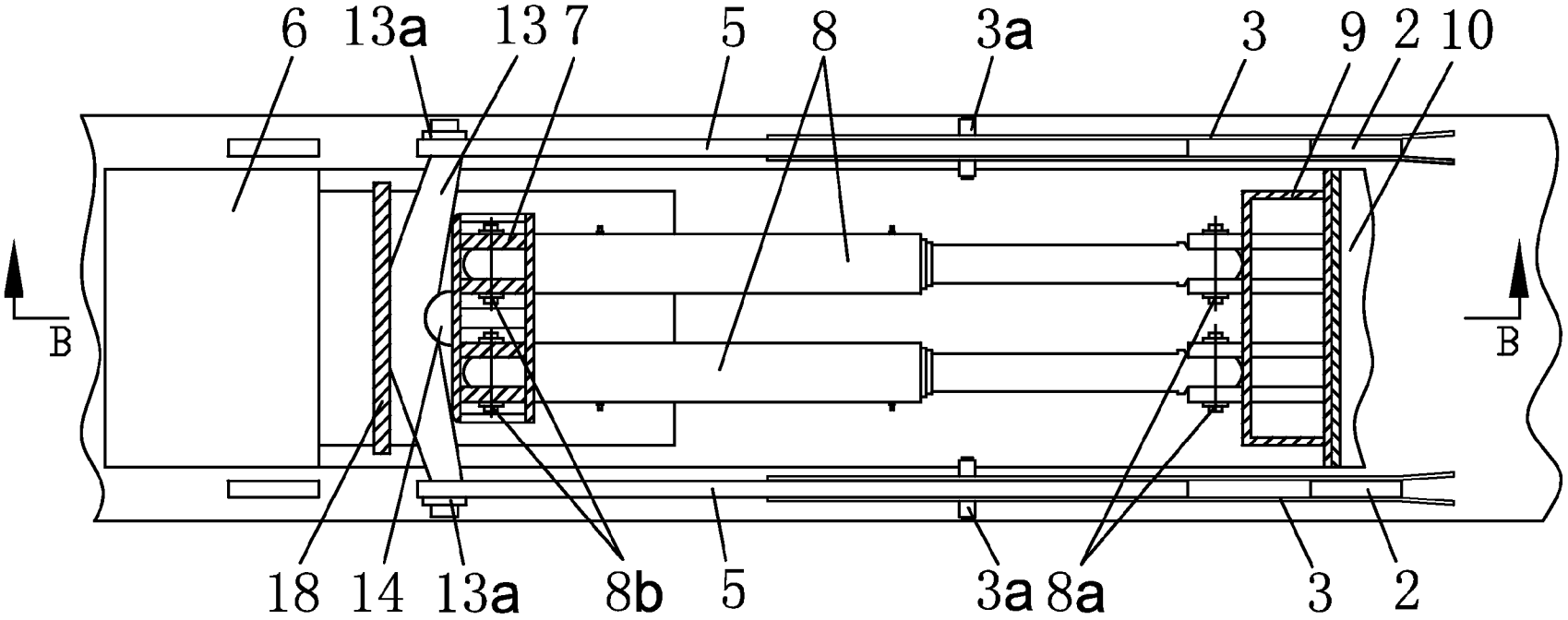
FIG. 3 is a sectional view of a hydraulic pushing device in FIG. 1 taken from line A-A.
Figure 4:
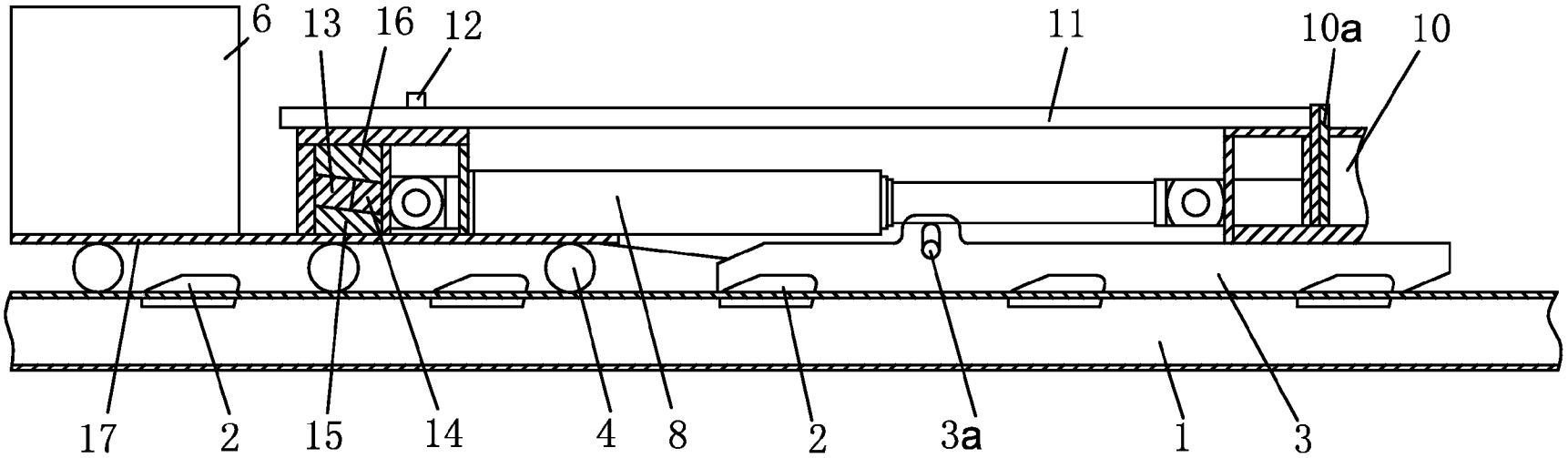
FIG. 4 is a sectional view of a hydraulic pushing device in FIG. 3 taken from line B-B.

As shown in FIGS. 1-4, take a slideway shifting system as an example, a hydraulic pushing device is disposed on a lower slide rail 1. The lower slide rail 1 is fixed on the ground. The objects to be shifted such as ships and marine structures are connected to an upper slide plate 10. The hydraulic pushing device is employed to push the upper slide plate 10 to move on the lower slide rail 1. The hydraulic pushing device comprises a hydraulic unit 6, a rear seat 7, a front seat 9, a prying mechanism, an automatic adjustment mechanism, and a zero-torque pushing mechanism. The hydraulic unit 6 and the rear seat 7 are disposed on a platform 17. Three rollers 4 are disposed at both sides of a bottom of the platform 17. The front seat 9 is in a fixed connection to the upper slide plate 10 via a connecting flange 10*a*.

The zero-torque pushing mechanism comprises two hydraulic cylinders 8, one end of each of the two hydraulic cylinders 8 is hinged to the rear seat 7 via a third hinge pin 8*b*, and the other end of each of the two hydraulic cylinders 8 is hinged to the front seat 9 via a second hinge pin 8*a*.

The automatic adjustment mechanism comprises a control lever 11 and two locating pieces 12, one end of the control lever 11 is in a fixed connection to the front seat 9, and the other end of the control lever 11 is clamped by the two locating pieces 12 fixed on the rear seat 7. Inclined support bars 11*a* in a fixed connection to the front seat 9 are disposed at two sides of the control lever 11, respectively. When the upper slide plate 10 deviates at a small angle, the front seat 9 in a fixed connection to the upper slide plate 10 also deviates at a certain angle, which further drives the control lever 11 to deviate. The deviated control lever 11 pokes two locating pieces 12 at abnormal angels whereby deviating the pushing mechanism. When the deviated pushing mechanism works, one pawl 5 is tightened, and the other pawl 5 is loose, so that one side of the upper slide plate 10 is stressed to rectify the deviated upper slide plate 10 to return to normal angle.

The prying mechanism comprises two pawls 5, a pawl shaft 13, two prying guides 3, and two rows of equidistantly-disposed stop pieces 2. The pawl shaft 13 is disposed between a baffle plate 18 and a front round block 14 leaning against the rear seat 7. The stop piece 2 is fixed on the lower slide rail 1, and corresponds to the pawl 5. A lower press block 15 is disposed at a lower part of the front round block 14 leaning against the pawl shaft 13, and an upper press block 16 is disposed at an upper part of the front round block 14. The two pawls 5 are interlocked with two ends of the pawl shaft 13, respectively, and are fixed using shaft sleeves 13*a*. A middle part of each pawl 5 is hinged to the prying guide 3 straddling the stop pieces via a first hinge pin 3*a*. The prying guide 3 employs two plates disposed at two sides of the stop piece 2, and the prying guide comprises a long pin hole matching the first hinge pin 3*a*. The front lower end face of the grab hook of the pawl matches the rear upper end face of the stop piece 2, no apex angle formed, which enables the pawl 5 to move forward along the top edge of the stop piece 2 smoothly. The rear end face of the grab hook of the pawl tightly cooperates with the front end face of the stop piece 2, which prevents the pawl 5 from moving backward. The prying guide 3 and the pawl 5 can move forward and backward in a coordinated type in the long pin hole of the prying guide 3. Furthermore, the pawl 5 can also move upward and downward in the long pin hole, but the prying guide cannot. That is to say, the pawl 5 can move forward, backward, upward, and downward, while the prying guide 3 can move only forward and backward. Thus, the pawl 5 is allowed to move along the direction where the stop pieces 2 are arranged.

The key design point of the zero-torque pushing mechanism lies in that, the point of force application between the pawl shaft 13 and the pushing mechanism, the point of force application between the hydraulic cylinders 8 and the pushing mechanism, and the point of force application between the pawls 5 and the stop pieces 2, are all co-linear. The generating line of the contact plane between the pawl shaft 13 and the front round block 14 is vertical to the above three points of force application.

When the hydraulic cylinders 8 lift, the pawls 5 grasp the stop pieces 2 tightly, and the hydraulic cylinders 8 push the upper slide plate to move forward. When the hydraulic cylinders 8 contract, because the front seat 9 is fixed on the loaded upper slide plate 10, the platform 17 and the pushing mechanism move forward. Under the drive of the pawl shaft 13, the pawls 5 and the first hinge pin 3*a* thereon push the prying guide 3 to lean against the stop pieces 2 and move forward within the tolerance range. The pawls 5 move upward and forward along the upper surface of the stop piece 2. The pawls 5 and the first hinge pin 3*a* thereon move in the long pin hole of the prying guide 3 and push the prying guide 3 to move forward. When the pawls 5 pass through the stop pieces 2, the pawls 5 and the first hinge pin 3*a* thereon fall from the long pin hole of the prying guide 3. Thereafter, the hydraulic cylinders 8 lift again for next cycle of pushing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A hydraulic pushing device, the hydraulic pushing device moving on a lower slide rail to push an upper slide plate disposed on the lower slide rail to shift, the hydraulic pushing device comprising:

1) a hydraulic unit;
2) a rear seat;
3) a front seat;
4) a prying mechanism;
5) an automatic adjustment mechanism; and
6) a zero-torque pushing mechanism;

wherein the hydraulic unit and the rear seat are disposed on a platform;

the front seat is in a fixed connection to the upper slide plate via a connecting flange;

the zero-torque pushing mechanism comprises two hydraulic cylinders, one end of each of the two hydraulic cylinders is hinged to the rear seat via a third hinge pin, and the other end of each of the two hydraulic cylinders is hinged to the front seat via a second hinge pin;

the automatic adjustment mechanism comprises a control lever and two locating pieces, one end of the control lever is in a fixed connection to the front seat, and the other end of the control lever is clamped by the two locating pieces which are fixed on the rear seat;

the prying mechanism comprises two pawls, a pawl shaft, two prying guides, and two rows of equidistantly-disposed stop pieces; the pawl shaft is disposed between a baffle plate and a front round block leaning against the rear seat; the two pawls are interlocked with two ends of the pawl shaft, respectively; a middle part of each pawl is hinged to the prying guide straddling the stop pieces via a first hinge pin;

when the hydraulic cylinders lift, the pawls grasp the stop pieces tightly, and the hydraulic cylinders push the upper slide plate to move forward; and when the hydraulic cylinders contract, the platform moves forward, under the drive of the pawl shaft, the pawls and the prying guide lean against the stop pieces and move forward until the pawls grasp next stop pieces for next cycle of pushing.

2. The device of claim 1, wherein the prying guide employs two plates disposed at two sides of the stop piece, and the prying guide comprises a long pin hole matching the first hinge pin.

3. The device of claim 1, wherein a lower press block is disposed at a lower part of the front round block leaning against the pawl shaft, and an upper press block is disposed at an upper part of the front round block.

4. The device of claim 1, wherein inclined support bars in a fixed connection to the front seat are disposed at two sides of the control lever, respectively.

5. The device of claim 1, wherein the stop pieces are fixed on the lower slide rail, and correspond to the pawl.

6. The device of claim 1, wherein rollers are disposed at both sides of a bottom of the platform.

* * * * *